US009822993B2

(12) United States Patent
Lesage et al.

(10) Patent No.: US 9,822,993 B2
(45) Date of Patent: Nov. 21, 2017

(54) TRANSCRITICAL R744 REFRIGERATION SYSTEM FOR SKATING RINKS WITH TOTAL CONDENSATION AND WITHOUT FLASH-GAS BYPASS

(71) Applicant: SYSTÈMES LMP INC., Laval (CA)

(72) Inventors: Gaétan Lesage, Blainville (CA); Jordan Kantchev, Longueuil (CA)

(73) Assignee: SYSTEMES LMP INC., Laval (CA)

( * ) Notice: Subject to any disclaimer, the term of this patent is extended or adjusted under 35 U.S.C. 154(b) by 419 days.

(21) Appl. No.: 14/559,085

(22) Filed: Dec. 3, 2014

(65) Prior Publication Data

US 2015/0153091 A1 Jun. 4, 2015

Related U.S. Application Data

(60) Provisional application No. 61/911,191, filed on Dec. 3, 2013.

(51) Int. Cl.

| | |
|---|---|
| ***F25B 1/00*** | (2006.01) |
| ***F25B 9/00*** | (2006.01) |
| ***F25B 7/00*** | (2006.01) |
| *A63C 19/10* | (2006.01) |
| *F25B 40/02* | (2006.01) |
| *F25B 33/00* | (2006.01) |
| *F25B 6/04* | (2006.01) |

(52) U.S. Cl.

CPC ..... *F25B 9/006* (2013.01); *F25B 7/00* (2013.01); *A63C 19/10* (2013.01); *F25B 6/04* (2013.01); *F25B 33/00* (2013.01); *F25B 40/02* (2013.01); *F25B 2309/061* (2013.01); *F25B 2341/0662* (2013.01); *F25B 2400/13* (2013.01); *F25B 2400/16* (2013.01); *F25B 2400/161* (2013.01); *F25B 2400/162* (2013.01)

(58) Field of Classification Search

CPC .... F25B 7/00; F25B 40/02; F25B 2341/0662; F25B 33/00; F25B 2400/16; F25B 2400/161; F25B 2400/162; F25B 6/04; F25B 2400/13; A63C 19/10

See application file for complete search history.

(56) References Cited

U.S. PATENT DOCUMENTS

| | | | | |
|---|---|---|---|---|
| 5,564,281 | A * | 10/1996 | Calton | F24F 3/1411 62/271 |
| 2006/0201188 | A1* | 9/2006 | Kopko | F25B 6/02 62/333 |
| 2012/0073319 | A1* | 3/2012 | Dube | F25B 9/008 62/235 |
| 2012/0227426 | A1* | 9/2012 | Deaconu | F25B 1/10 62/115 |
| 2013/0239603 | A1* | 9/2013 | Albertson | F25B 7/00 62/238.6 |

* cited by examiner

*Primary Examiner* — David Teitelbaum
(74) *Attorney, Agent, or Firm* — Gonzalo Lavin

(57) ABSTRACT

A transcritical R-744 refrigeration system, especially used for refrigerating a skating rink, has a heat exchanger between the gas cooler followed by a throttling device and the flash tank (or receiver), in order to eliminate the need of a flash-gas bypass. The heat exchanger connects to an external mechanical refrigeration system operating at a higher evaporating temperature than the transcritical R-744 refrigeration system, and generally totally condenses the vapor of the R-744 refrigerant before it reaches the flask tank. A method for improving the energy efficiency of the transcritical R-744 refrigeration system is also disclosed.

8 Claims, 2 Drawing Sheets

TRANSCRITICAL R744 REFRIGERATION SYSTEM FOR SKATING RINKS WITH TOTAL CONDENSATION AND WITHOUT FLASH-GAS BYPASS

CROSS REFERENCE TO RELATED APPLICATIONS

Benefit of priority of US Provisional Application for Patent Ser. No. 61/911,191, filed on Dec. 3, 2013, which is incorporated herein by reference, is hereby claimed.

FIELD OF THE INVENTION

The present invention relates to transcritical R-744 refrigeration systems, and more specifically to transcritical R-744 refrigeration systems for skating rinks with total condensation and without flash-gas bypass,

BACKGROUND OF THE INVENTION

A typical R-744 transcritical refrigeration system uses a flash-gas bypass between the receiver and the suction inlet of the transcritical compressors. The use of flash-gas bypass is necessary due to the fact that at elevated ambient temperature (around 90° F.) the mass flow of R-744 after the throttling device comprises about 55% liquid and 45% vapors (these values are function of the evaporating temperature). The vapors must be fed back to the compressors suction in order to maintain the compressors mass flow rate. It is clear that only a portion of the compressors mass flow is used to feed the evaporators thus reducing greatly the energy efficiency of the compressors (EER).

The need to improve the cycle efficiency during the warmer periods of the year is obvious.

Accordingly, there is a need for an improved transcritical R-744 refrigeration system.

SUMMARY OF THE INVENTION

It is therefore a general object of the present invention to provide an improved transcritical R-744 refrigeration system and method.

An advantage of the present invention is that the system and method for skating (or icing) rinks for a transcritical R-744 refrigeration system has high energy efficiency ratio at elevated ambient temperatures without flash-gas bypass, and with preferably total (or entire) condensation of the refrigerant via a heat exchanger operatively connected to an external refrigeration system.

According to an aspect of the present invention, there is provided a transcritical R-744 refrigeration system having an evaporator member receiving a R-744 refrigerant at a low pressure liquid state from a flash tank member for feeding a compressor member to compress the R-744 refrigerant from a low pressure gaseous state into a high pressure gaseous state to feed a gas cooler member and a throttling device member to partially condense the R-744 refrigerant into a high pressure gaseous-liquid state, said transcritical R-744 refrigeration system comprising:

a heat exchanger member connecting to an external mechanical refrigeration system operating at a higher evaporating temperature than the transcritical R-744 refrigeration system, the heat exchanger member receiving the partially condensed R-744 refrigerant from the throttling device member and substantially totally condensing the R-744 refrigerant before feeding the flash tank member so as to allow only the R-744 refrigerant in the low pressure gaseous state from the evaporator member to feed the compressor member.

In one embodiment, the heat exchanger member receives the partially condensed R-744 refrigerant from the throttling device member entirely condensing the R-744 refrigerant.

Conveniently, the transcritical R-744 refrigeration system is used to refrigerate a skating rink.

According to another aspect of the present invention, there is provided a method for improving the energy efficiency of a transcritical R-744 refrigeration system having an evaporator member receiving a R-744 refrigerant at a low pressure liquid state from a flash tank member for feeding a compressor member to compress the R-744 refrigerant from a low pressure gaseous state into a high pressure gaseous state to feed a gas cooler member and a throttling device member to partially condense the R-744 refrigerant into a high pressure gaseous-liquid state before reaching the flash tank member, said method comprising the step of:

connecting a heat exchanger member to the transcritical R-744 refrigeration system between the throttling device member and the flash tank member, the heat exchanger member connecting to an external mechanical refrigeration system operating at a higher evaporating temperature than the transcritical R-744 refrigeration system, the heat exchanger member substantially totally condensing the partially condensed R-744 refrigerant received from the throttling device member before feeding the flash tank member so as to allow only the R-744 refrigerant in the low pressure gaseous state from the evaporator member to feed the compressor member.

In one embodiment, the step of connecting a heat exchanger member includes the heat exchanger member entirely condensing the partially condensed R-744 refrigerant received from the throttling device member before feeding the flash tank member.

Other objects and advantages of the present invention will become apparent from a careful reading of the detailed description provided herein, with appropriate reference to the accompanying drawings.

BRIEF DESCRIPTION OF THE DRAWINGS

Further aspects and advantages of the present invention will become better understood with reference to the description in association with the following Figures, in which similar references used in different Figures denote similar components, wherein.

DETAILED DESCRIPTION OF THE INVENTION

With reference to the annexed drawings the preferred embodiment of the present invention will be herein described for indicative purpose and by no means as of limitation.

Figure 1:
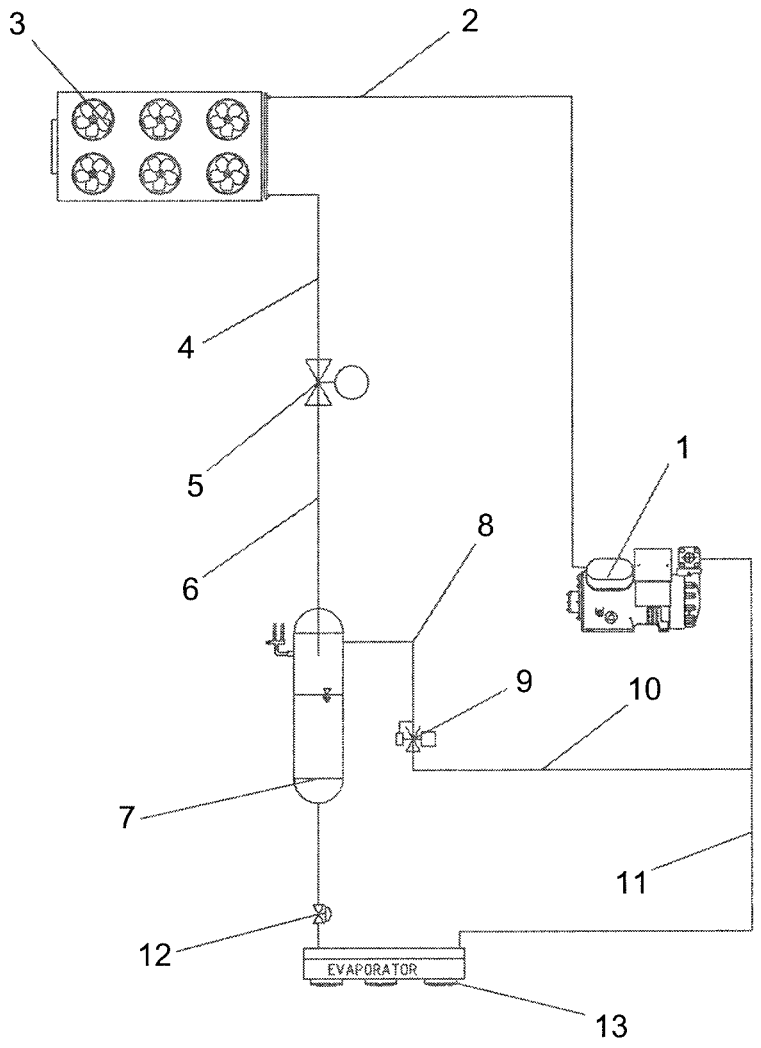
FIG.1 (PRIOR ART)
FIG. 1 is a schematic view of a prior art transcritical R-744 refrigeration system having a flash-gas bypass arrangement.

Referring to FIG. 1, there is schematically shown a transcritical R-744 refrigeration system having a flash-gas bypass arrangement well known in the art. The compressed R-744 vapors from compressor 1 are fed through conduit 2 to the gas cooler 3, where their temperature is reduced from the heat transfer with the ambient air. Then the R-744 vapors having reduced temperature but still at high pressure are fed through conduit 4 to the throttling device 5, where their temperature and pressure are reduced thus provoking partial condensation. After the throttling device the mixture of vapors and liquid, at about 50% each, are fed by means of conduit 6 to the receiver 7 (sometimes called flash tank) where separation of the vapors from the liquid occurs. The resulting liquid is fed through expansion valve 12 to the evaporator 13 where it evaporates due to heat transfer with the surrounding ambient and the resulting vapors are fed through conduit 11 to the compressor 1.

The excess vapors from the receiver 7, where the pressure is higher in comparison with the suction pressure of the compressor 1 in order to insure correct operation of the expansion valve 12, is then fed through bypass conduit 8 to the pressure reducing valve 9 and having its pressure reduced to the level of the compressor 1 suction pressure is fed through conduit 10 to the suction conduit 11 of compressor 1.

Figure 2:
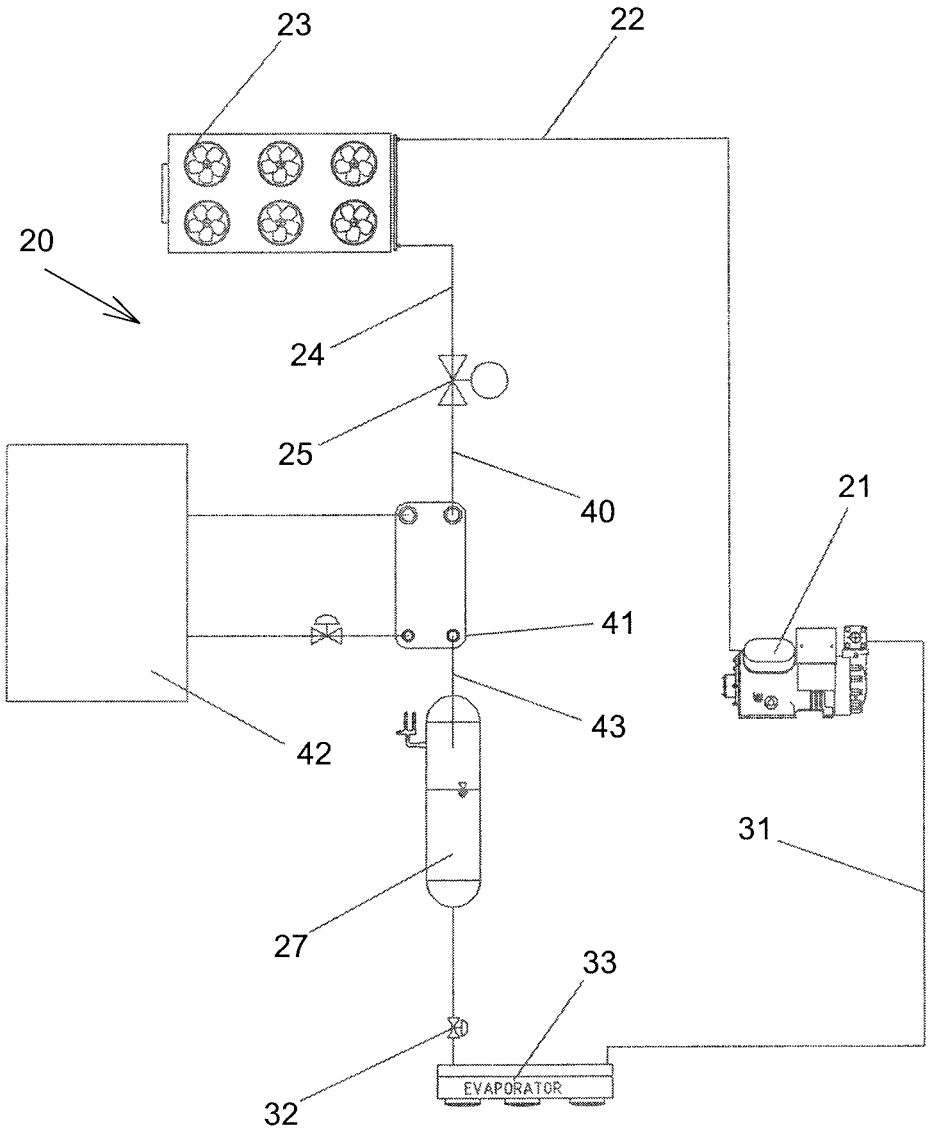
FIG. 2 is a schematic view of a transcritical R-744 refrigeration system having total condensation and no flash-gas bypass arrangement in accordance with an embodiment of the present invention.

Referring to FIG. 2, there is schematically shown a transcritical R-744 refrigeration system 20 having no flash-gas bypass arrangement and typically total condensation in accordance with an embodiment of the present invention, as a refrigeration system used to refrigerate a skating rink (not shown). The compressed R-744 refrigerant vapors from compressor member 21 are fed through conduit 22 to the gas cooler member 23, where their temperature is reduced from the heat transfer with the ambient air. Then the R-744 having reduced temperature but still at high pressure are fed through conduit 24 to the throttling device member 25, where their temperature and pressure are reduced thus provoking partial condensation. The mixture of vapors and liquid is then fed through conduit 40 to heat exchanger member 41 where, by means of an external mechanical refrigeration system 42 typically operating also with R-744 refrigerant but at higher evaporating temperature and thus having much higher energy efficiency, the excess vapor is substantially totally condensed, with the excess vapor being preferably entirely condensed. From heat exchanger 41 the liquid is fed to receiver member 27 (or flash tank member) and through expansion valve 32 along conduit 43 to evaporator member 33. Accordingly, only the vapors from evaporator 33 are fed through conduit 31 to the suction inlet of compressor 21. No flash-gas bypass is required as the total of the compressor flow rate is converted into liquid.

The present invention also refers to a corresponding method for improving the energy efficiency of a transcritical R-744 refrigeration system 20 having an evaporator member 33 that receives a R-744 refrigerant at a low pressure liquid state from a flash tank member 27 to feed a compressor member 21 which compresses the R-744 refrigerant from a low pressure gaseous state into a high pressure gaseous state. The compressor member 21 feeds a gas cooler member 23 and a throttling device member 25 to partially condense the R-744 refrigerant into a high pressure gaseous-liquid state before reaching the flash tank member 27. The method includes the step of: connecting a heat exchanger member 41 to the transcritical R-744 refrigeration system 20 between the throttling device member 25 and the flash tank member 27. The heat exchanger member 41 connects to an external mechanical refrigeration system 42 operating at a higher evaporating temperature than the transcritical R-744 refrigeration system 20, the heat exchanger member 41 substantially totally condenses, and preferably entirely, the partially condensed R-744 refrigerant received from the throttling device member 25 before feeding the flash tank member 27 so as to allow only the R-744 refrigerant in the low pressure gaseous state from the evaporator member 33 to feed the compressor member 21.

Although the present invention has been described with a certain degree of particularity, it is to be understood that the disclosure has been made by way of example only and that the present invention is not limited to the features of the embodiments described and illustrated herein, but includes all variations and modifications within the scope of the invention as hereinafter claimed.

We claim:

1. A transcritical R-744 refrigeration system having an evaporator member receiving a R-744 refrigerant at a low pressure liquid state from a flash tank member for feeding a compressor member to compress the R-744 refrigerant from a low pressure gaseous state into a high pressure gaseous state to feed a gas cooler member and a throttling device member to partially condense the R-744 refrigerant into a high pressure gaseous-liquid state, said transcritical R-744 refrigeration system comprising:

a heat exchanger member connecting to an external mechanical refrigeration system operating at a higher evaporating temperature than the transcritical R-744 refrigeration system, the heat exchanger member receiving the partially condensed R-744 refrigerant from the throttling device member and substantially totally condensing the R-744 refrigerant before feeding the flash tank member so as to allow only the R-744 refrigerant in the low pressure gaseous state from the evaporator member to feed the compressor member, wherein the R-744 refrigeration system does not include a flash-gas bypass as the total of R-744 refrigerant is converted into liquid by the heat exchanger member.

2. The system of claim 1, wherein the heat exchanger member receiving the partially condensed R-744 refrigerant from the throttling device member entirely condenses the R-744 refrigerant.

3. The system of claim 1, wherein the transcritical R-744 refrigeration system is used to refrigerate a skating rink.

4. The system of claim 2, wherein the transcritical R-744 refrigeration system is used to refrigerate a skating rink.

5. A method for improving the energy efficiency of a transcritical R-744 refrigeration system having an evaporator member receiving a R-744 refrigerant at a low pressure liquid state from a flash tank member for feeding a compressor member to compress the R-744 refrigerant from a low pressure gaseous state into a high pressure gaseous state to feed a gas cooler member and a throttling device member to partially condense the R-744 refrigerant into a high pressure gaseous-liquid state before reaching the flash tank member, said method comprising the step of:

connecting a heat exchanger member to the transcritical R-744 refrigeration system between the throttling device member and the flash tank member, the heat exchanger member connecting to an external mechanical refrigeration system operating at a higher evaporating temperature than the transcritical R-744 refrigeration system, the heat exchanger member substantially totally condensing the partially condensed R-744 refrigerant received from the throttling device member before feeding the flash tank member so as to allow only the R-744 refrigerant in the low pressure gaseous state from the evaporator member to feed the compressor member, wherein the R-744 refrigeration system does not include a flash-gas bypass as the total of R-744 refrigerant is converted into liquid by the heat exchanger member.

6. The method of claim 5, wherein the step of connecting a heat exchanger member includes the heat exchanger member entirely condensing the partially condensed R-744 refrigerant received from the throttling device member before feeding the flash tank member.

7. The method of claim 5, wherein the transcritical R-744 refrigeration system is used to refrigerate a skating rink.

8. The method of claim 6, wherein the transcritical R-744 refrigeration system is used to refrigerate a skating rink.

* * * * *